US006612215B2

(12) United States Patent
Takeuchi

(10) Patent No.: US 6,612,215 B2
(45) Date of Patent: Sep. 2, 2003

(54) CUTTING MACHINE

(75) Inventor: Shinichi Takeuchi, Tokyo (JP)

(73) Assignee: Max Co., Ltd., Tokyo (JP)

( * ) Notice: Subject to any disclaimer, the term of this patent is extended or adjusted under 35 U.S.C. 154(b) by 242 days.

(21) Appl. No.: 09/875,199

(22) Filed: Jun. 8, 2001

(65) Prior Publication Data

US 2001/0049989 A1 Dec. 13, 2001

(30) Foreign Application Priority Data

Jun. 9, 2000 (JP) ..... P2000-173653
Jun. 9, 2000 (JP) ..... P2000-173654

(51) Int. Cl.[7] ..... B26D 5/38
(52) U.S. Cl. ..... 83/370; 83/614; 83/563; 83/575
(58) Field of Search ..... 83/614, 423, 563–564, 83/171

(56) References Cited

U.S. PATENT DOCUMENTS

| | | | | |
|---|---|---|---|---|
| 4,558,266 A | * | 12/1985 | Sasaki et al. | 318/571 |
| 4,854,205 A | * | 8/1989 | Anderka | 83/529 |
| 5,262,617 A | * | 11/1993 | Higashiguchi | 219/221 |
| 5,331,872 A | * | 7/1994 | Fuchigami et al. | 83/171 |
| 5,454,287 A | | 10/1995 | Fuchigami et al. | 83/881 |
| 5,634,388 A | * | 6/1997 | Fuchigami et al. | 83/881 |
| 6,276,778 B1 | * | 8/2001 | Katayama | 347/28 |
| 6,283,011 B1 | * | 9/2001 | Assumel-Lurdin | 92/134 |

FOREIGN PATENT DOCUMENTS

| | | | | |
|---|---|---|---|---|
| DE | 29 31 970 A1 | | 2/1981 | |
| DE | 41 07 801 A1 | | 9/1992 | |
| EP | 0 960 740 A1 | | 12/1999 | |
| EP | 1 145 840 A2 | | 10/2001 | |
| FR | 2 647 386 A1 | | 3/1989 | |
| FR | 2 647 386 | * | 3/1989 | ..... B26D/3/08 |
| FR | 2 647 386 A1 | | 11/1990 | |
| JP | 11-309694 | | 4/1998 | |
| JP | 11-333785 | | 5/1998 | |
| JP | 11-309694 A | | 11/1999 | |
| JP | 11-333785 A | | 12/1999 | |

* cited by examiner

*Primary Examiner*—Allan N. Shoap
*Assistant Examiner*—Ghassem Alie
(74) *Attorney, Agent, or Firm*—Morgan, Lewis & Bockius LLP

(57) ABSTRACT

A cutting machine for cutting a belt-shaped sheet into a given shape includes a sheet feeder, a Y-axis shaft, a carriage, a sub-shaft, two connecting frames, and an elevating device. The sheet feeder moves the belt-shaped sheet in the X-axis direction. The Y-axis shaft is disposed in the Y-axis direction above the cutting sheet. The carriage mounts a cutter on a leading end thereof and is slidably disposed on the Y-axis shaft. The sub-shaft is disposed parallel to the Y-axis shaft and penetrates the carriage on the leading end side of the carriage. The connecting frames connects and fixes the Y-axis shaft and the sub-shaft to each other. The elevating device moves up and down the sub-shaft to move the cutter up and down in the Z-axis direction with respect to the cutting sheet.

7 Claims, 11 Drawing Sheets

CUTTING MACHINE

BACKGROUND OF THE INVENTION

1. Field of the Invention

The present invention relates to a cutting machine for cutting a cutting sheet moving in the X-axis direction into a given shape using a cutter moving in the Y-axis direction and, in particular, to an elevating mechanism provided in such a cutting machine for contacting and separating the cutter with respect to the cutting sheet.

Further, the present invention relates to a structure for arranging an origin detecting sensor which is used to detect the origin of a carriage with a cutter mounted thereon in a cutting machine.

2. Description of the Related Art

Generally, as a cutting machine for cutting a cutting sheet into a given shape, there is known a cutting machine in which not only a carriage is moved in the X- and Y-axis directions with respect to a stationary cutting sheet but also the carriage is moved in the Z-axis direction to thereby contact and separate a cutter with respect to the cutting sheet, whereby the cutting sheet is cut into a given shape.

However, the above-mentioned cutting machine, in which the cutter is moved directly in the X- and Y-axis directions, is complicated in structure as well as requires an expensive bearing and troublesome wire arrangement. Especially, a mechanism for moving up and down a carriage with a cutter in the Z-axis direction requires high accuracy and is thereby inevitably complicated in structure. That is, because such direct-moving mechanism or linear mechanism moves the cutter up and down, there is employed a structure that a cutter holder itself is guided linearly with respect to the carriage. For this reason, a guide for guiding the cutter holder is requested to have such high-accuracy parallelism that, when it moves, it is can be prevented against play (in the case of insufficient parallelism, when it is used for a long period of time, it plays heavily and is thereby worn excessively); and, therefore, the manufacturing cost of the guide is expensive.

Further, in a related cutting machine when the cutting machine cuts out a character or a figure from a cutting sheet, the origin of a carriage (cutter) is previously detected to thereby control the position of the carriage. In such position control, the amount of movement of the carriage up to the then position of the carriage is determined with the origin position of the carriage as the standard to thereby control the amount of rotation of a carriage driving motor. For this purpose, when the power is turned on, it is necessary to detect the origin position of the carriage. In order to detect the origin position of the carriage, a sensor lever is disposed on the carriage and also, in order to be able to confirm that the carriage has returned to the origin by detecting the sensor lever, there is disposed an origin detecting sensor on the main body of the cutting machine.

However, in the above-mentioned cutting machine, once the origin is detected, it is not necessary to detect the origin unless the power is turned off. Therefore, when the cutting machine is put into its normal cutting operation, in order to prevent the sensor lever from interfering (colliding) with the origin detecting sensor, the start point of movement of the carriage must be set at a position which is moved by a given amount from the origin, which makes it inevitable to spread the entire width of the cutting machine by an amount equivalent to such space.

SUMMARY OF THE INVENTION

The present invention aims at eliminating the drawbacks found in the above-mentioned conventional cutter elevating mechanism. Accordingly, it is a first object of the invention to provide a cutter elevating mechanism in a cutting machine which is simple in structure and is able to operate with sufficient accuracy.

Further, it is a second object of the invention to provide a structure for arranging an origin detecting sensor in a cutting machine, which can eliminate the need for provision of a space for relief of a sensor lever disposed so as to detect the origin of a carriage to thereby reduce the size of the cutting machine.

In order to attain the first object, the present invention provides a cutter elevating mechanism in a cutting machine for cutting a belt-shaped cutting sheet moving in the X-axis direction into a given shape with a cutter moving in the Y- and Z-axis directions. The following are features of the present invention. A Y-axis shaft is disposed in the Y-axis direction above the cutting sheet. A carriage with a cutter mounted on the leading end thereof is disposed on the Y-axis shaft in such a manner that it can be slid along the Y-axis shaft. A sub-shaft parallel to the Y-axis shaft is disposed so as to penetrate the leading end side of the carriage. The two ends of the Y-axis shaft and the sub-shaft are respectively connected and fixed to each other through connecting frames, whereby the sub-shaft is moved up and down using an elevating device to thereby move the cutter up and down in the Z-axis direction with respect to the cutting sheet.

Further, in order to attain the second object, the present invention provides a structure for an arrangement of an origin detecting sensor in a cutting machine for cutting a belt-shaped cutting sheet moving in the X-axis direction into a given shape with a cutter moving in the Y- and Z-axis directions. The following are features of the present invention. A Y-axis shaft is disposed in the Y-axis direction above the cutting sheet. A carriage with a cutter mounted on the leading end thereof is disposed on the Y-axis shaft in such a manner that it can be slid along the Y-axis shaft in the Y-axis direction. A sub-shaft parallel to the Y-axis shaft is disposed so as to penetrate the leading end side of the carriage. The two ends of the Y-axis shaft and the sub-shaft are respectively connected and fixed to each other through connecting frames to thereby form a frame assembly. A sensor lever is disposed on the carriage so as to project in the origin direction. On the connecting frames, there is arranged an origin detecting sensor for detecting the sensor lever when the carriage is moved in the origin direction, whereby the sub-shaft is moved in the vertical direction using an elevating device to thereby swing the frame assembly up and down about the Y-axis shaft and move the cutter up and down in the Z-axis direction with respect to the cutting sheet. The origin detecting sensor and the carriage can be moved in the vertical direction in synchronization with each other.

DETAILED DESCRIPTION OF THE PREFERRED EMBODIMENTS

The first preferred embodiment of a cutting machine according to the present invention will be described with reference to the accompanying drawings of FIGS. 1 to 4.

Figure 1:
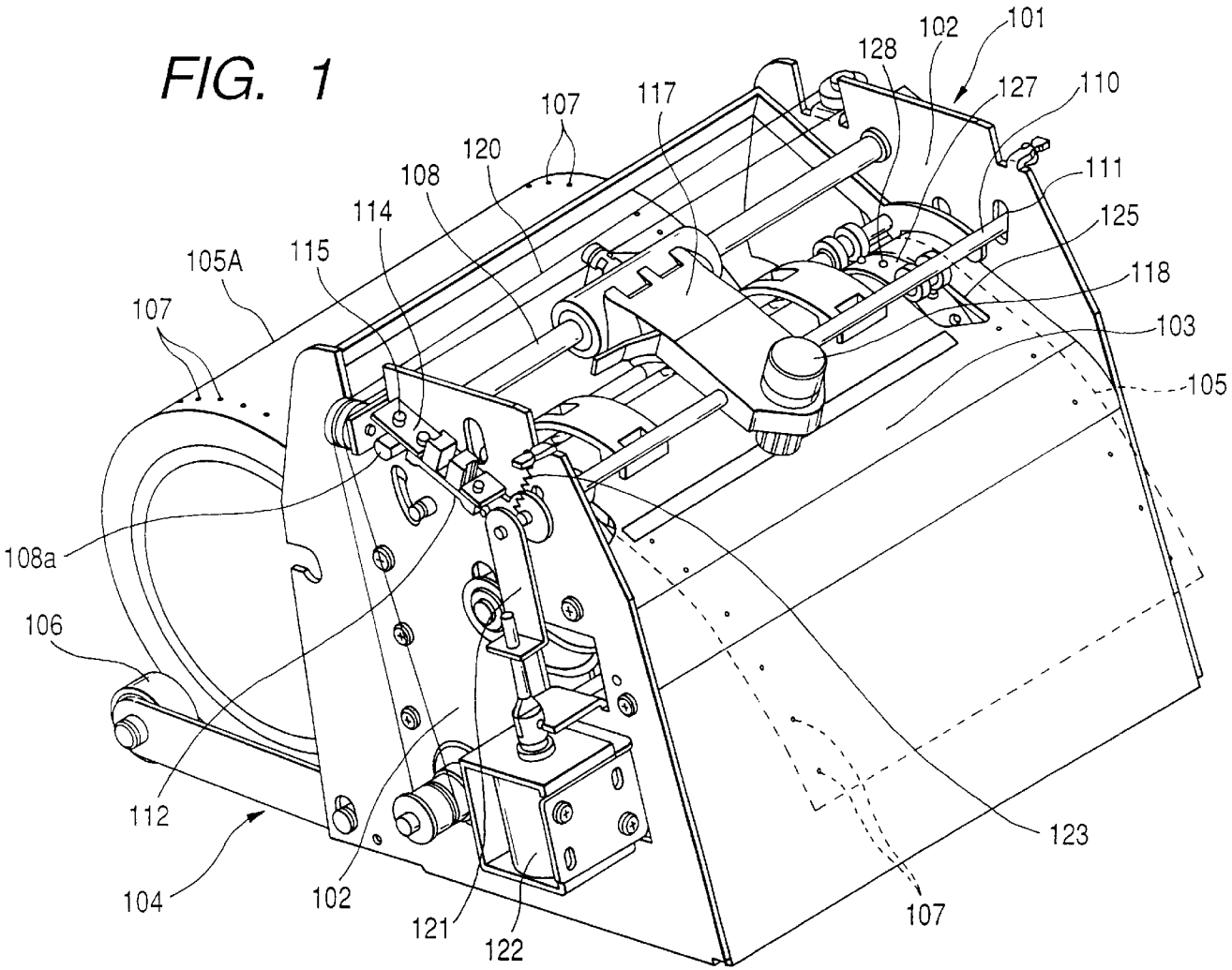
FIG. 1 is a perspective view of the main portions of a first embodiment of a cutting machine according to the invention.
Figure 2:
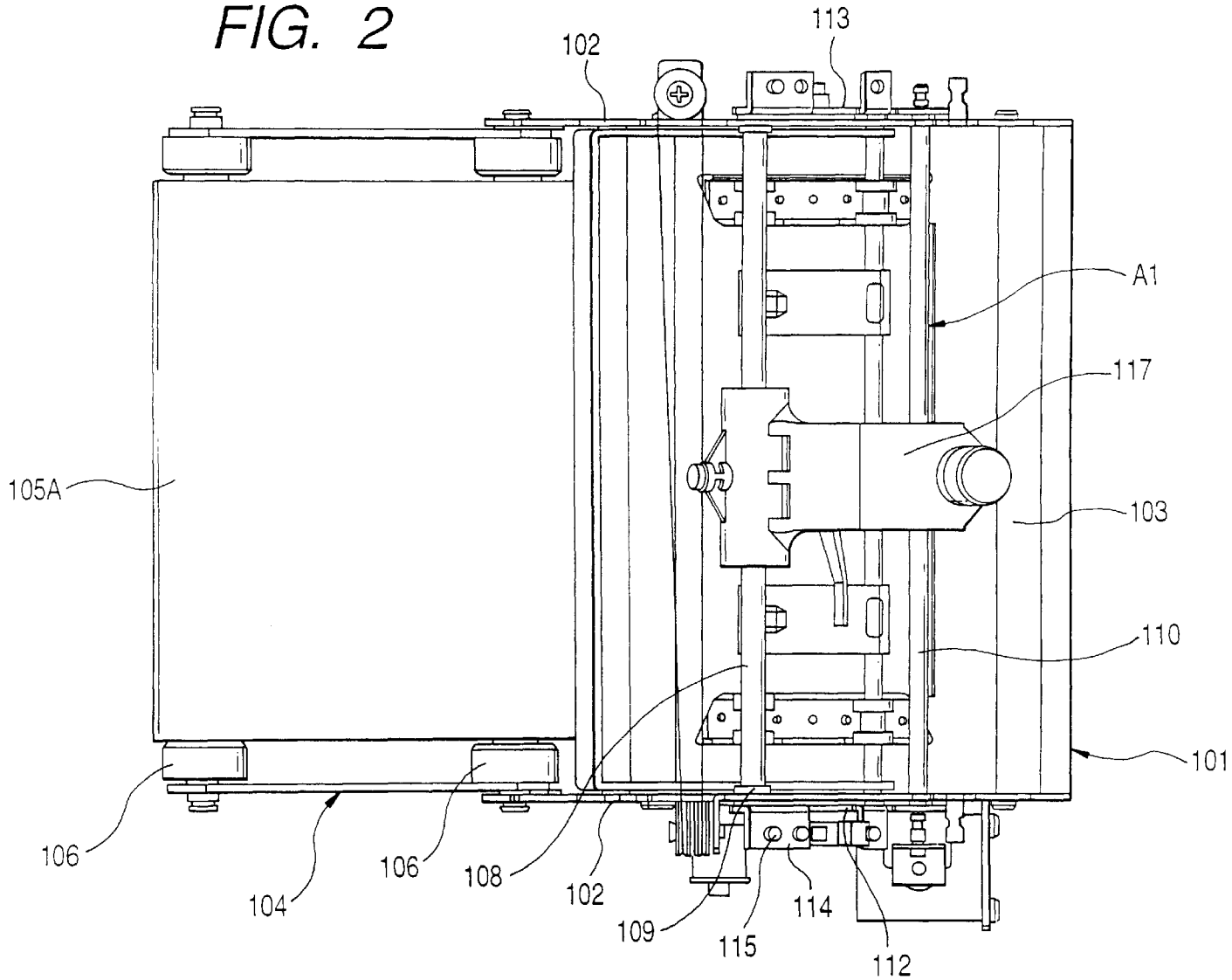
FIG. 2 is a longitudinal section view of the cutting machine of the first embodiment shown in FIG. 1.
Figure 3:
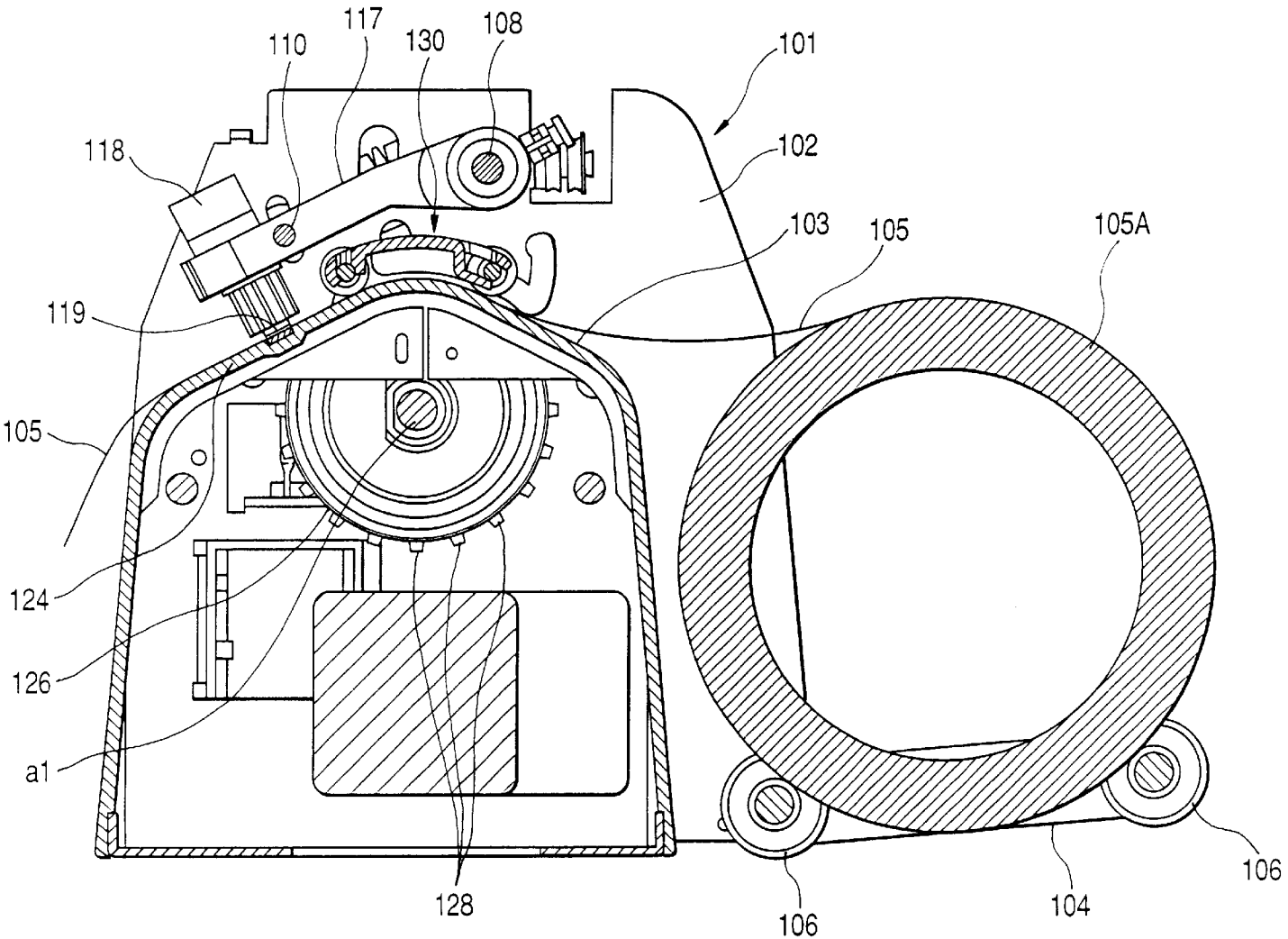
FIG. 3 is a side view of the cutting machine of the first embodiment.
Figure 4:
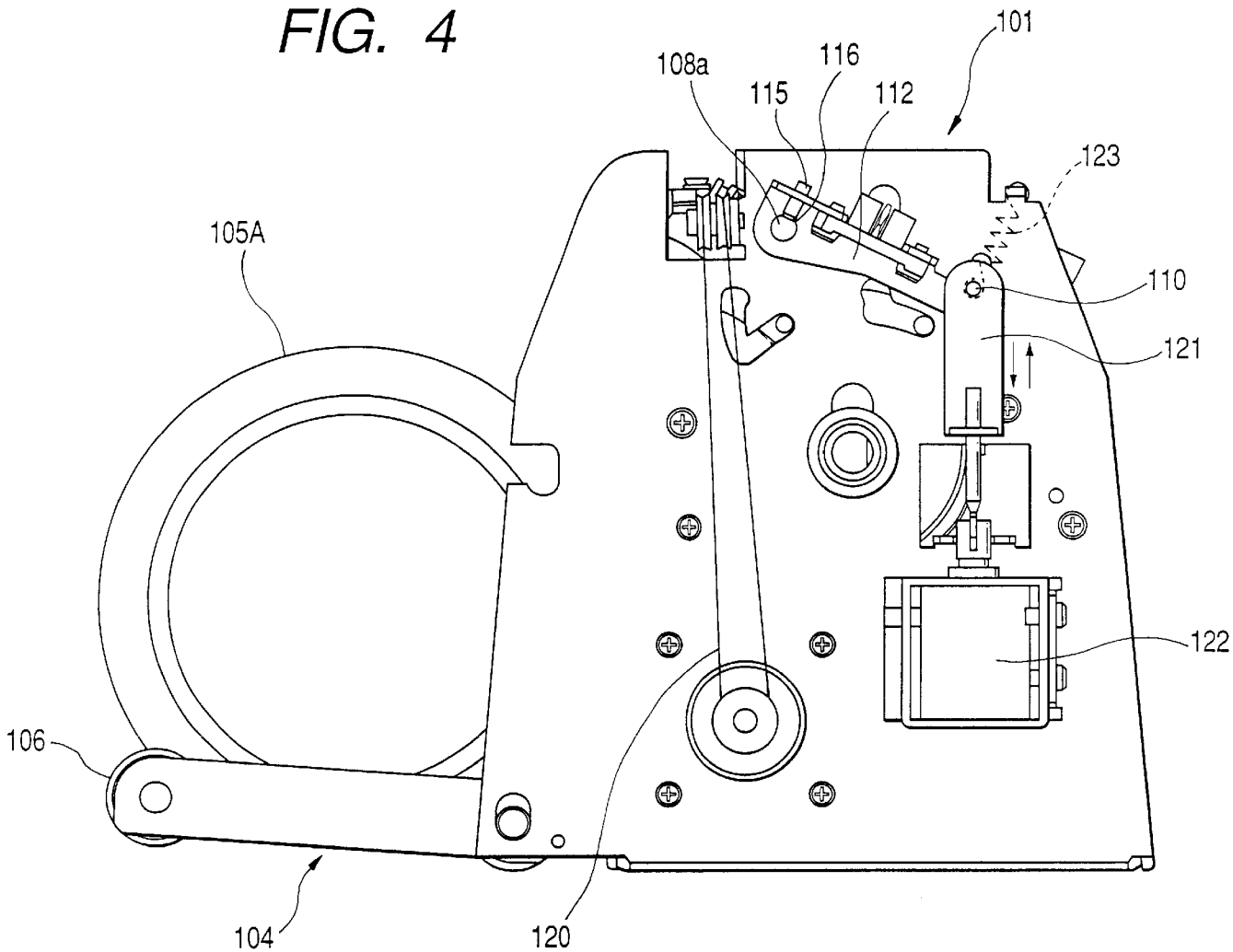
FIG. 4 is a plan view of the cutting machine of the first embodiment.

FIG. 1 is a perspective view of the main portions of an embodiment of a cutting machine; FIG. 2 is a longitudinal section view thereof; FIG. 3 is a side view thereof; and FIG. 4 is a plan view thereof. In these drawings, reference character 101 designates a machine main body which includes two side plates 102 disposed respectively on the two sides thereof. Between the two side plates 102, there is formed a sheet guide surface 103 the central portion of which is formed in an angular shape. Next to the sheet guide surface 103, there is disposed a roller holder 104 on which there is held a sheet roller 105A with a cutting sheet 105 wound therearound. In the front and rear portions of the roller holder 104, there are disposed a pair of rollers 106 each so that the roller 105A can be rotated easily.

On the two sides of the cutting sheet 105, there are formed holes 107 at regular intervals.

On the sheet guide surface 103, there is disposed a Y-axis shaft 108. The Y-axis shaft 108 is rotatably supported by two bearing holes 109 respectively formed in the side plates 102 as well as penetrates the bearing holes 109 and projects externally therefrom. The two projecting ends 108*a* of the Y-axis shaft 108 are each formed in a D shape. On the downstream side of the Y-axis shaft 8, there is disposed a sub-shaft 110; and, the sub-shaft 110 also penetrates two elongated holes 111 formed in the side plates 102 and projects externally therefrom. The two ends of the Y-axis shaft 108 are respectively connected to the two ends of the sub-shaft 110 through connecting frames 112, 113. The connecting frames 112, 113 are each formed by bending a plate. The connecting frames 112, 113 respectively include bent portions 114 formed on the end portions thereof that are situated on the side of bearing holes 109 of the Y-axis shaft 108; and, setscrews 115 are threadedly engaged with the connecting frames 112, 113 through the bent portions 114 and the leading ends of the setscrews 115 are engaged with plane portions 116 respectively formed in the two end portions of the Y-axis shaft 108, thereby being able to prevent the connecting frames 112, 113 against play. Also, to the other-side ends of the connecting frames 112, 113, there are fixed the two ends of the sub-shaft 110, respectively. In this manner, the Y-axis shaft 108, sub-shaft 110 and connecting frames 112, 113 are fixed to one another and, as a whole, they are formed in a square-shaped frame assembly A1.

Next, on the Y-axis shaft 108, there is disposed a carriage 117 in such a manner that it is slidable along the Y-axis shaft 108. The carriage 117 is engaged with the Y-axis shaft 108 through a slide bearing or a slide bush and also, on the leading end portion of the carriage 117, there is mounted a cutter 119 through a cutter holder 118. The sub-shaft 110 penetrates the carriage 117, while the carriage 117 can be slid along the sub-shaft 110. The carriage 117 is operatively connected to a servo motor (not shown) through a wire 120. The sub-shaft 110 serves also as a sub-guide which guides the carriage 117 to move in the Y-axis direction.

Also, one end of the sub-shaft 110 is connected through an adjust frame 121 to a solenoid 122, and the sub-shaft 110 is also energized by a return spring 123 in such a manner that it is normally present on the upper end of the elongated hole 111. When the solenoid 122 is turned on, the sub-shaft 110 is allowed to move downward along the elongated hole 111. Further, when the solenoid 122 is turned off, the sub-shaft 110 is moved upward by the return spring 123. That is, the sub-shaft 110 can be moved up and down by an elevating device that consists of the solenoid 122 and return spring 123 and, with the elevating movement of the sub-shaft 110, the carriage 117 can be swung about the Y-axis shaft 108, so that the cutter 119 can be moved in the Z-axis direction.

Next, on the two sides of a surface plate 124 which forms the seat guide surface 103, there are formed openings 125, and from these openings 125, there are exposed the outer peripheral surfaces of a sprocket 126 which is disposed in the interior portion of the machine main body 101. The sprocket 126 is rotatably supported on a support shaft a1, and, on the outer peripheral surfaces 127, there are disposed projections 128 which can be engaged with the holes 107 formed on the two sides of the cutting sheet 105 in such a manner that the intervals of the projections 128 are equal to those of the holes 107. Inside of the openings 125, there are disposed sheet holders 130. The sprocket 126 is operatively connected to the servo motor (not shown) in such a manner that the former can be operated synchronously with the latter.

According to the above structure, according to a preset program, the sprocket 126 is rotated to thereby move the cutting sheet 105 forwardly or backwardly in the X-axis direction along the sheet guide surface 103, the carriage 117 is moved in the Y-axis direction along the Y-axis shaft 108, and the sub-shaft 110 is moved up and down by the solenoid 122 and return spring 123 to thereby move up and down the cutter 119 in the Z-axis direction, so that the cutting sheet 105 can be cut out into a given shape.

As described above, when the cutter 119 moves up and down, not only the sub-shaft 110 moves up and down, but also the frame assembly A1 consisting of the sub-shaft 10, Y-axis shaft 8 and connecting frames 112, 113 is integrally swung in the vertical direction about the Y-axis shaft 108. As a result of this, the cutter 119 disposed on the leading end portion of the carriage 117 is allowed to move up and down in synchronization with the frame assembly A1. Since the connecting frames 112, 113 are respectively fixed to the Y-axis shaft 108 and sub-shaft 110, the frame assembly A1 is allowed to operate as a strong integral body. Due to this, when one side of the sub-shaft 110 is swung in the vertical direction, the other side of the sub-shaft 110 can be also swung in the vertical direction by the same amount. Therefore, the elevating device for moving up and down the cutter 119 may be disposed only on one end of the sub-shaft 110. Even if the structure of the elevating device is simple, it can operate with sufficient accuracy. The elevating device is not limited to the solenoid and return spring but, of course, an actuator such as a moving coil or a motor can also be used.

Also, since the Y-axis shaft 108 can be used as a support shaft for moving the cutter 119 in the Z-axis direction, the elevating mechanism for moving up and down the cutter 119 can be simplified in structure as well as can be manufactured at a low cost.

Next, the second preferred embodiment of a cutting machine according to the present invention will be described with reference to the accompanying drawings of FIGS. 5 to 11(*b*).

Figure 5:
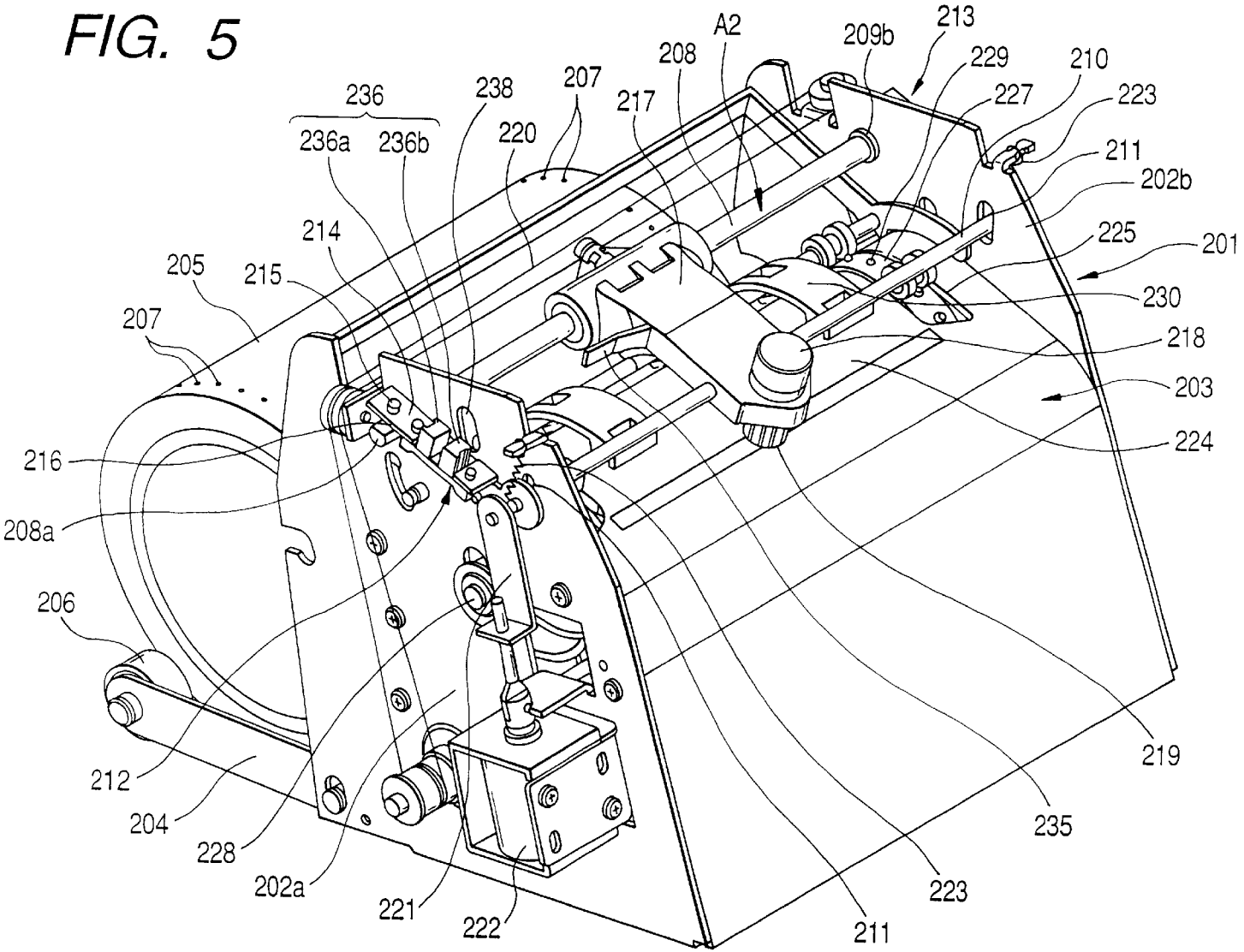
FIG. 5 is a perspective view of the main portions of a second embodiment of a cutting machine according to the invention.
Figure 6:
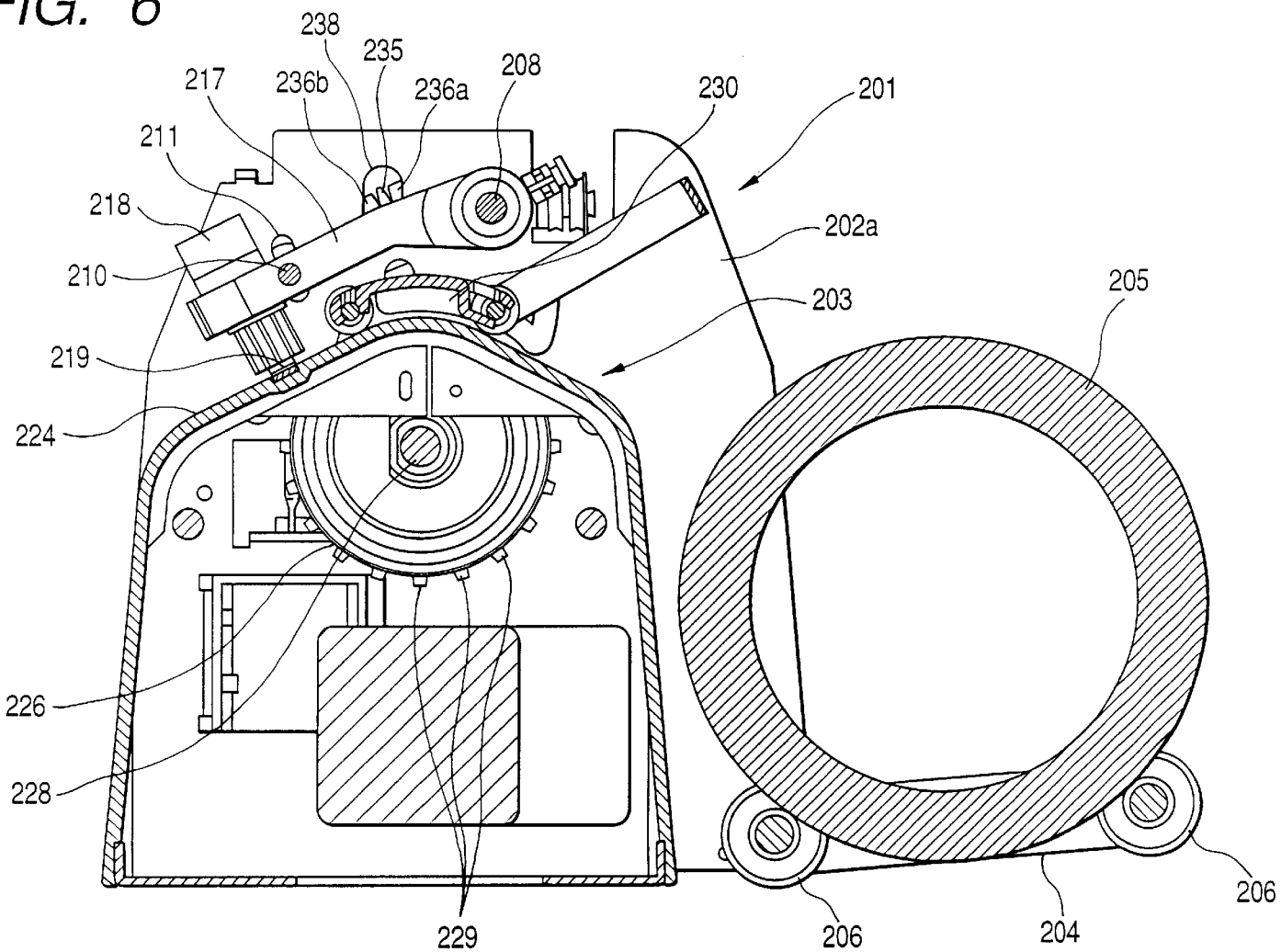
FIG. 6 is a longitudinal section view of the second embodiment of the cutting machine.
Figure 7:
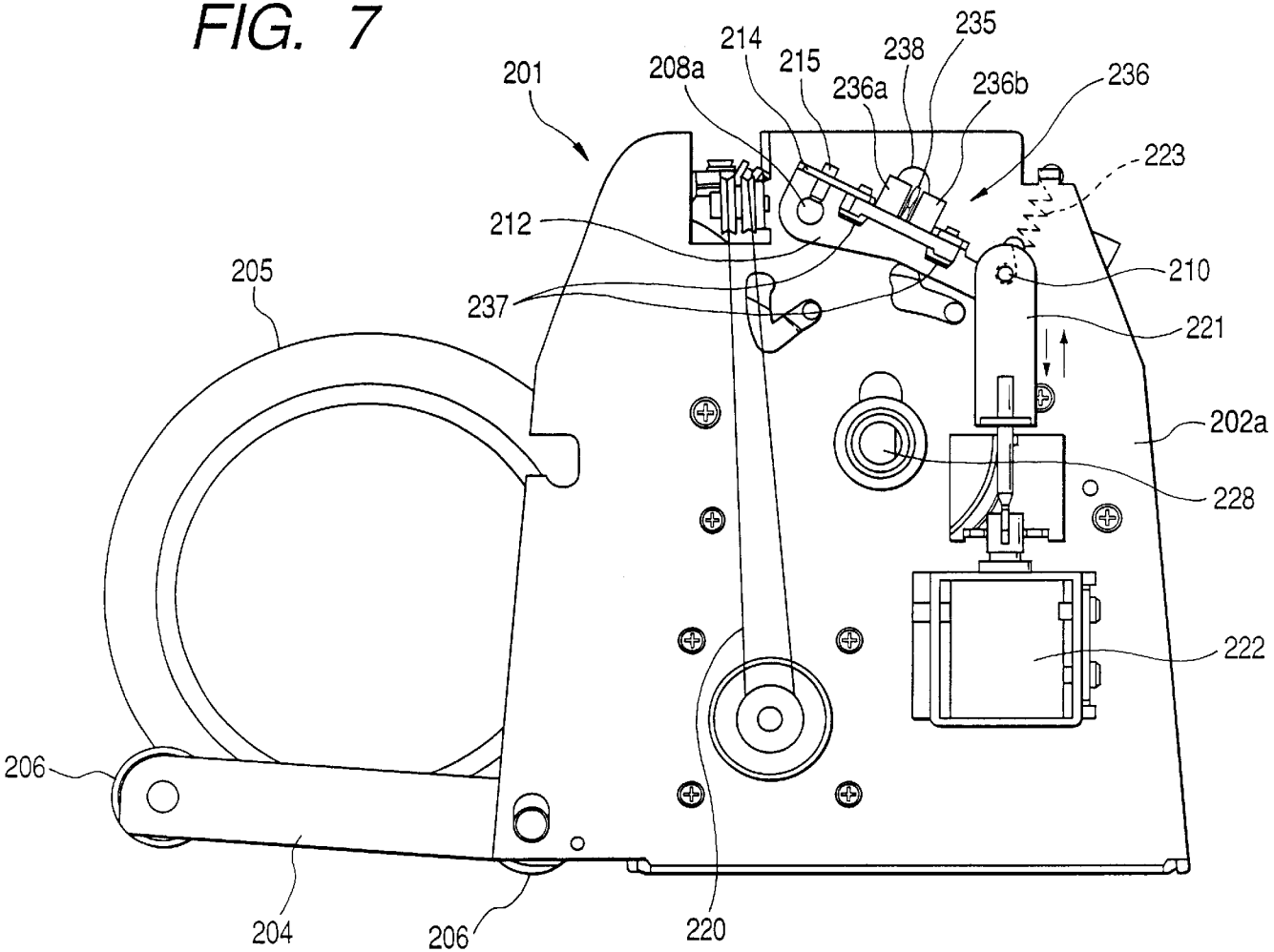
FIG. 7 is a side view of the second embodiment of the cutting machine.
Figure 8:
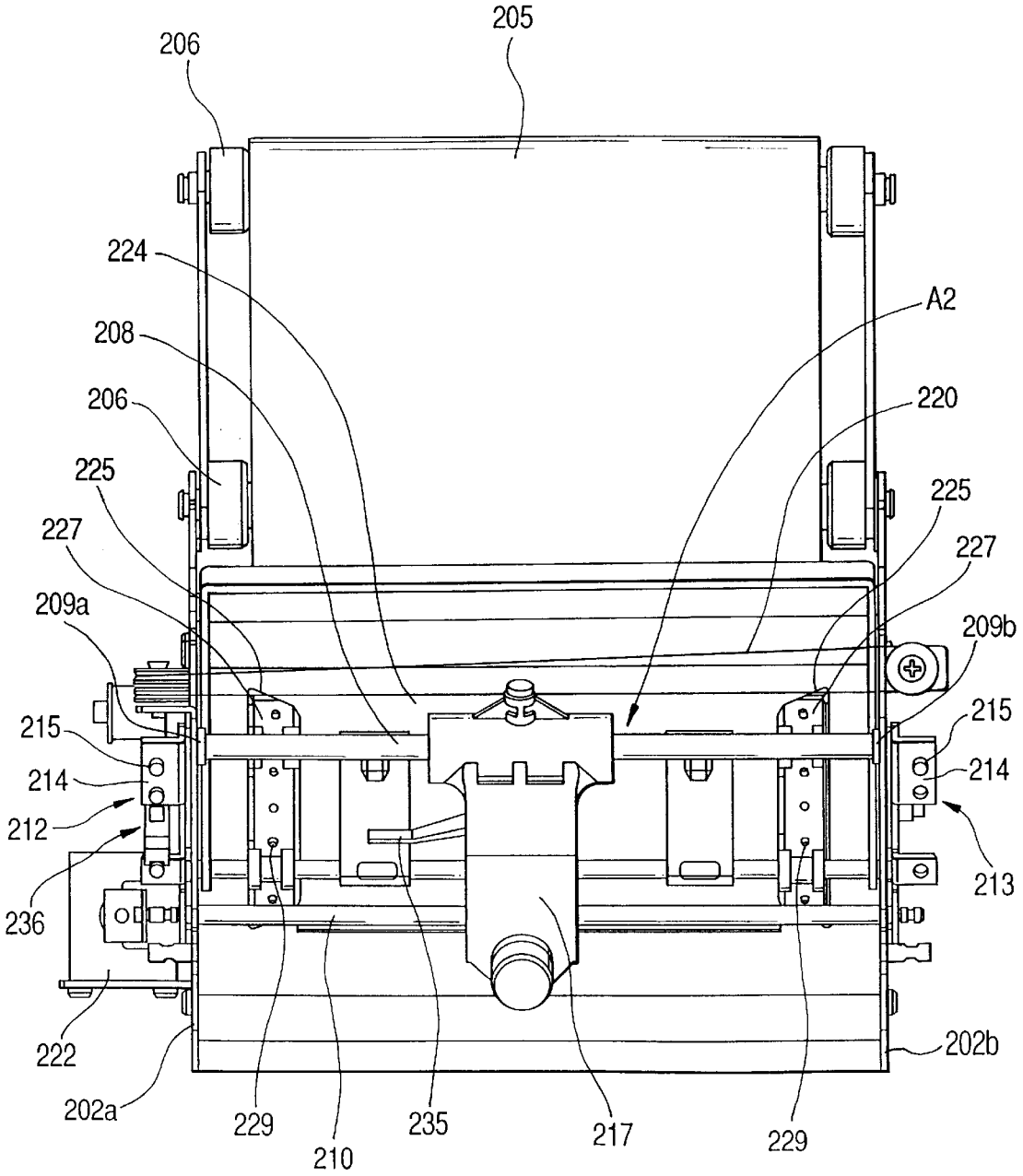
FIG. 8 is a plan view of the second embodiment of the cutting machine.
Figure 9:
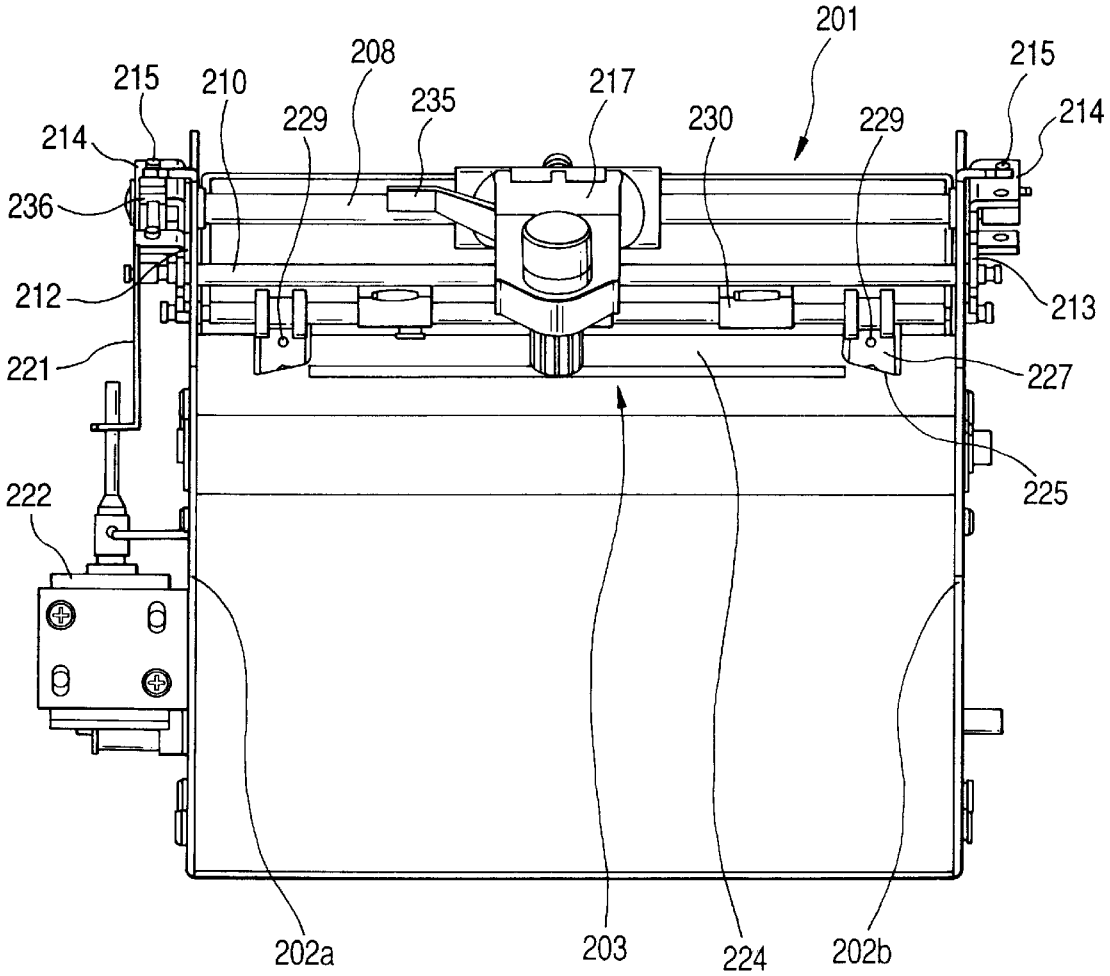
FIG. 9 is a front view of the second embodiment of the cutting machine.

FIG. 5 is a perspective view of the main portions of a second embodiment of a cutting machine, FIG. 6 is a longitudinal section view of the cutting machine, FIG. 7 is a side view thereof, and FIG. 8 is a plan view thereof. In these drawings, reference character 201 designates a machine main body. Between the two side plates 202*a,* 202*b* of the machine main body 201, there is interposed a sheet guide surface 203, the central portion of which is formed in an angular shape, next to the sheet guide surface 203, there is disposed a roller holder 204 and, on the roller holder 204, there is placed a cutting sheet 205 which is wound in a roller shape. On the front and rear sides of the roller holder 204, there are disposed a pair of rollers 206 so as to be able to facilitate the rotation of the roll-shaped cutting sheet 5.

On the two sides of the cutting sheet 205, there are formed holes 207 at regular intervals respectively.

On the upper side of the sheet guide surface 203, there is disposed a Y-axis shaft 208. The Y-axis shaft 208 is rotatably supported on the bearings 209*a,* 209*b* of the right and left side plates 202*a,* 202*b,* while the two ends 208*a* of the Y-axis shaft 208 respectively penetrating their associated bearings 209*a,* 209*b* and projecting outwardly on the side plates 202*a,* 202*b* are each formed so as to have a D-shaped section. On the downstream side with respect to the Y-axis shaft 208, there is disposed a sub-shaft 210 which also penetrates elongated holes 211 respectively formed in their associated side plates 202*a,* 202*b* and projects outwardly from the side plates 202*a,* 202*b*. The two ends of the Y-axis shaft 208 and sub-shaft 210 are connected to each other through connecting frames 212, 213.

The connecting frames 212, 213 are respectively formed by bending a plate, and setscrews 215 are threadedly engaged with their associated connecting frames 212, 213 from the bent portions 214 of the end portions of the connecting frames 212, 213 on the sides of bearings 209*a,* 209*b* of the Y-axis shaft 208, while the leading ends of the setscrews 215 are respectively engaged with plane portions 216 respectively formed in the two end portions of the Y-axis shaft 208 to thereby prevent the Y-axis shaft 208 against play. To the other ends of the connecting frames 212, 213, there are fixed the two ends of the sub-shaft 210, respectively. In this manner, the Y-axis shaft 208, sub-shaft 210 and connecting frames 212, 213 are fixed to one another, thereby forming a square frame assembly A2 as a whole.

Next, on the Y-axis shaft 208, there is disposed a carriage 217 in such a manner that it can be slid along the Y-axis shaft 208. The carriage 217 is engaged with the Y-axis shaft 208 through a slide bearing or a slide bush. On the leading end portion of the carriage 217, there is mounted a cutter 219 through a cutter holder 218. The sub-shaft 210 penetrates the carriage 217, while the carriage 217 can be slid along the sub-shaft 210. The carriage 217 is operatively connected to a servo motor (not shown) through a wire 220. The sub-shaft 210 serves also as a sub-guide which guides the carriage 217 to move in the Y-axis direction.

One end of the sub-shaft 210 is connected through an adjust frame 221 to a solenoid 222, while the sub-shaft 210 is energized by a return spring 223 in such a manner that it is normally present on the upper ends of the elongated holes 211. When the solenoid 222 is turned on, the sub-shaft 210 can be moved down along the elongated holes 211, and when the solenoid 222 is turned off, the sub-shaft 210 can be moved upward by the return spring 223. That is, the sub-shaft 210 can be moved in the vertical direction by an elevating device which consists of the solenoid 222 and the return spring 223 and, with the vertical movement of the sub-shaft 210, the carriage 217 can be swung about the Y-axis shaft 208 in the vertical direction (Z-axis direction). When the carriage 217 is swung downward, the cutting edge of the cutter 219 is contacted with the cutting sheet 205 set on the sheet guide surface 203 to thereby be able to cut the cutting sheet 205.

Next, on the two sides of a surface plate 224 which forms the sheet guide surface 203, there are formed openings 225, respectively. From the openings 225, there are exposed the outer peripheral surfaces 227 of a sprocket 226 which is disposed in the interior portion of the machine main body 201. The sprocket 226 is rotatably supported on a support shaft 228, and, on the outer peripheral surface 227 of the sprocket 226, there are disposed projections 229 which can be respectively engaged with their associated holes 207 formed on the two sides of the cutting sheet 205 in such a manner that the intervals of the projections 229 are equal to those of the holes 207. Inside of the openings 225, there is disposed a sheet holder 230. The sprocket 226 is operatively connected to a servo motor (not shown).

On the left side portion of the carriage 217, there is mounted a plate-shaped sensor lever 235 in such a manner that it projects in the origin direction (that is, toward the side of the side frame 202*a*). On the connecting frame 212, there is fixed an origin detecting sensor 236 by screws 237. The origin detecting sensor 236 is composed of a transmission-type photointerrupter and includes a light emitting section 236*a* and a light receiving section 236*b*. When the leading end portion of the sensor lever 235 moves into a slit formed between the light emitting section 236*a* and light receiving section 236*b* to thereby cut off the incident light to the light receiving section 236*b,* a control section (not shown) is able to judge that the carriage 217 has reached its origin position. In the side frame 202*a,* there is formed a vertically long opening 238 so that the leading end portion of the sensor lever 235 is able to penetrate the side frame 202*a* regardless of the vertical position of the carriage 217.

Figure 10:
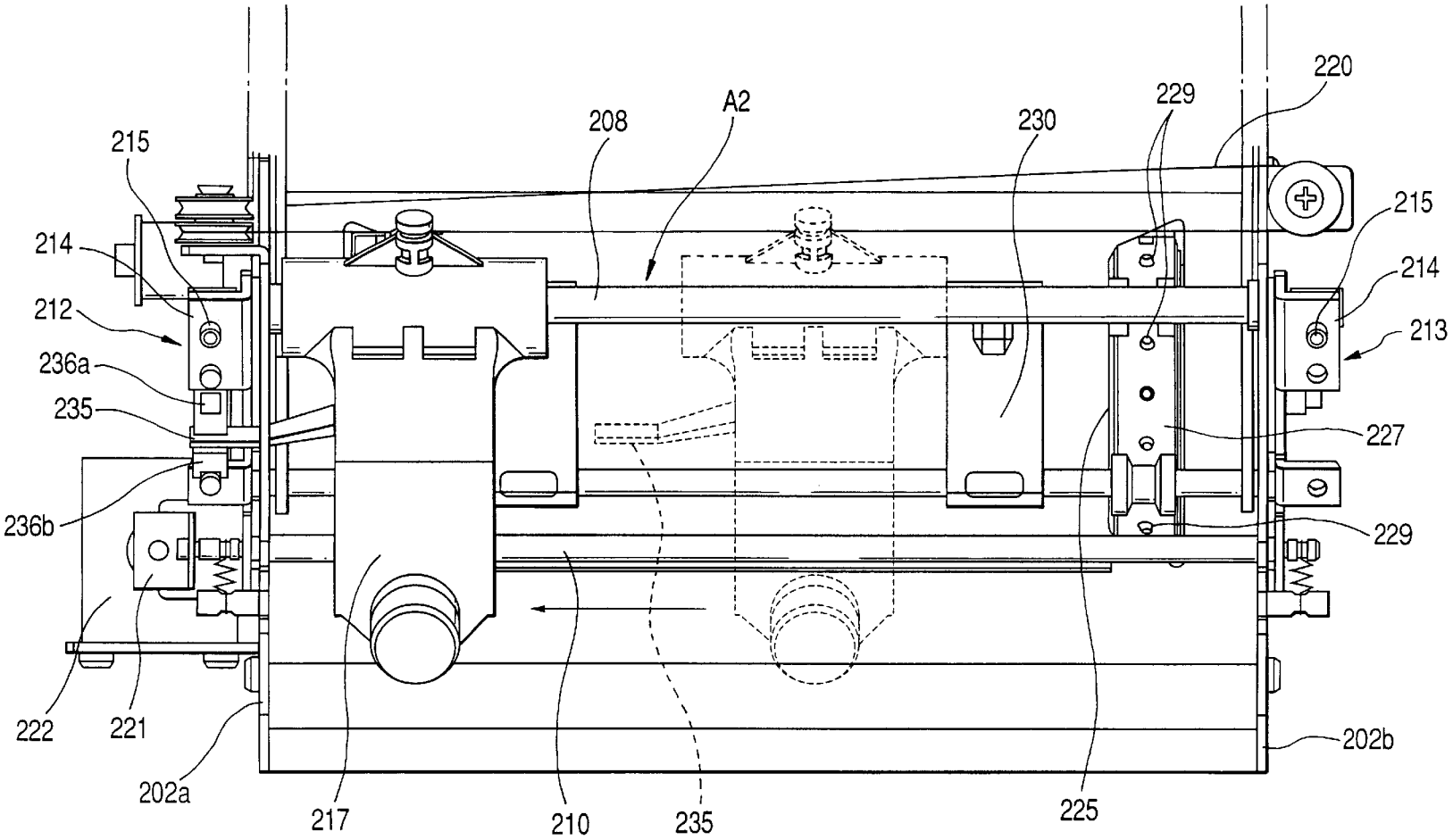
FIG. 10 is a plan view of the cutting machine according to the second embodiment, showing the movement of a carriage in the origin direction.
Figure 11B:
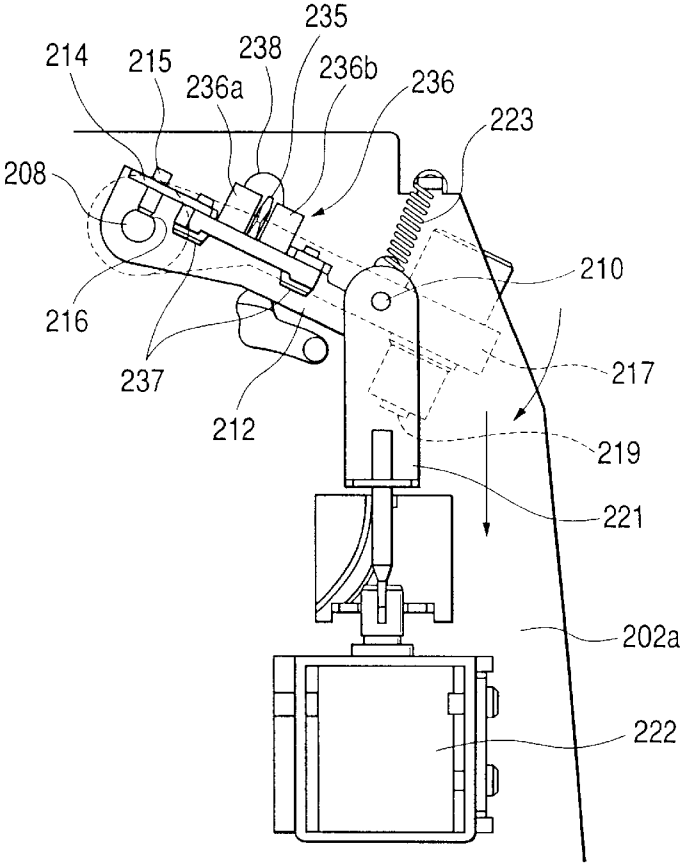
FIGS. 11(*a*) and 11(*b*) are respectively explanatory views of the relation between the origin detecting sensor and sensor lever.
Figure 11A:
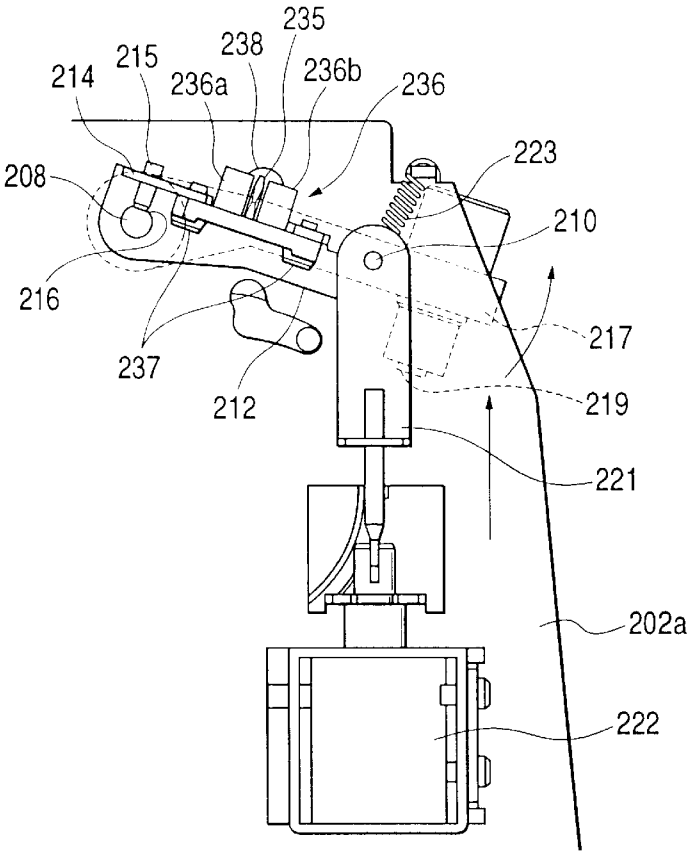

According to the above structure, when the power is turned on, the carriage 217 moves along the Y-axis shaft 208 toward the side of the side frame 202*a* (origin side) in order to detect the origin position of the carriage 217 according to a control program. As shown in FIG. 10, when the leading end portion of the sensor lever 235 passes through the opening 238 of the side frame 202*a* and moves into the slit formed between the light emitting section 236*a* and light receiving section 236*b* of the photointerrupter 236 to thereby cut off the incident light to the light receiving part 236*b,* the control section confirms that the carriage 217 has reached the origin, and thus the control section controls the amount of movement of the carriage 217 in the Y-axis direction with the origin as the standard.

Once the origin is detected, unless the power is turned off, even if the sensor lever 235 moves into the slit of the photointerrupter 236 to thereby cut off the incident light to the light receiving section 236*b,* the control section is prevented from updating the origin.

If the cutting machine is put into an actual cutting operation, while moving the cutting sheet 205 in the X-axis direction and the carriage 217 in the Y-axis direction, the sub-shaft 217 is moved in the vertical direction using the solenoid 222 and return spring 223 to move the cutter up and down in the Z-axis direction, thereby being able to cut the cutting sheet 205 into a given shape.

In this operation, while the cutter 219 remains held at the lowered position (that is, while the cutter 219 is cutting the cutting sheet 205), the carriage 217 can move in the Y-axis direction toward the side frame 202*a,* and the sensor lever 235 can penetrate the opening 238 of the side frame 202*a* and can moves to an upper position without interfering (colliding) with the photointerrupter 236. This is because the photointerrupter 236 is fixed on the connecting frame 212, is and the upper and lower positions of the photointerrupter 236 are moved in synchronization with the vertical movement of the carriage 217. Therefore, the leading end of the sensor lever 235 can always maintain a state in which it is able to move into the slit of the photointerrupter 236 (see FIGS. 11(*a*) and 11(*b*)).

As described above, since the carriage 217 and origin detecting sensor (photointerrupter) 236 are arranged on the frame assembly A2, the vertical movements of the carriage 217 and photointerrupter 236 are always synchronized with each other. Therefore, even if the cutting edge of the cutter has moved to the full extent of the effective width (the space between the holes 207 of both sides) of the cutting sheet 205 and, as shown in FIG. 10, the sensor lever 235 has moved through the side frame 202*a,* the leading end of the sensor lever 235 is always allowed to move into the slit between the light emitting part 236*a* and light receiving part 236*b* without interfering with the photointerrupter 236. Therefore, there is eliminated the need for provision of the space for relief of the sensor lever 235 between the side frame 202*a* and carriage 217 when the carriage 217 moves to the origin direction side, which makes it possible to reduce the breadth of the machine main body and reduce the size of the cutting machine.

According to the invention, since there is eliminated the need for providing a space for relief of a sensor lever to detect the origin of a carriage, there can be provided a structure for an arrangement of an origin detecting sensor which makes it possible to reduce the size of a cutting machine.

While only certain embodiments of the invention have been specifically described herein, it will be apparent that numerous modifications may be made thereto without departing from the spirit and scope of the invention.

What is claimed is:

1. A cutting machine for cutting a belt-shaped sheet into a given shape, comprising:

a sheet feeder for moving the belt-shaped sheet in the X-axis direction;

a Y-axis shaft disposed in the Y-axis direction above the cutting sheet;

a carriage mounting a cutter on a leading end thereof and slidably disposed on said Y-axis shaft;

a sub-shaft parallel to said Y-axis shaft and penetrating said carriage on the leading end side of said carriage;

two connecting frames forming a frame assembly by connecting and fixing said Y-axis shaft and said sub-shaft to each other at each end of said Y-axis shaft and said sub-shaft; and an elevating device for moving up and down said sub-shaft to move the frame assembly up and down about said Y-axis shaft and to move the cutter up and down in the Z-axis direction with respect to the cutting sheet.

2. The cutting machine according to claim 1, wherein said elevating device comprises:

a solenoid connected to an end of said sub-shaft; and a return spring energizing said sub-shaft upward in the Z-axis direction, wherein, when said solenoid is turned on, said sub-shaft is allowed to move downward, and wherein, when said solenoid is turned off, said sub-shaft is moved upward by said return spring.

3. The cutting machine according to claim 1, wherein said carriage further comprises a sensor lever projecting in a direction of an origin of said carriage, and said cutting machine further comprising:

an origin detecting sensor for detecting the sensor lever of said carriage when said carriage is moved in the direction of the origin, said origin detecting sensor disposed on one of said connecting frames, wherein said origin detecting sensor and said carriage are movable in the Z-axis direction in synchronization with each other.

4. The cutting machine according to claim 3, wherein said elevating device comprises:

a solenoid connected to an end of said sub-shaft; and a return spring energizing said sub-shaft upward in the Z-axis direction, wherein, when said solenoid is turned on, said sub-shaft is allowed to move downward, and wherein, when said solenoid is turned off, said sub-shaft is moved upward by said return spring.

5. The cutting machine according to claim 3, wherein said origin detecting sensor is a photointerrupter including a light emitting section and a light receiving section.

6. A cutter elevating mechanism in a cutting machine for cutting a belt-shaped sheet moving in the X-axis direction into a given shape with a cutter moving in the Y- and Z-axis directions, said cutter elevating mechanism comprising:

a Y-axis shaft disposed in the Y-axis direction above the cutting sheet;

a carriage mounting a cutter on a leading end thereof and slidably disposed on said Y-axis shaft;

a sub-shaft parallel to said Y-axis shaft and penetrating said carriage on the leading end side of said carriage;

two connecting frames, each of said connecting frames connecting and fixing said Y-axis shaft and said sub-shaft to each other at each end of said Y-axis shaft and said sub-shaft; and an elevating device for moving up and down said sub-shaft to move the cutter up and down in the Z-axis direction with respect to the cutting sheet.

7. A structure for an arrangement of an origin detecting sensor in a cutting machine for cutting a belt-shaped sheet moving in the X-axis direction into a given shape with a cutter moving in the Y- and Z-axis directions, said structure comprising:

a Y-axis shaft disposed in the Y-axis direction above the cutting sheet;

a carriage mounting a cutter on a leading end thereof and including a sensor lever projecting in a direction of an origin of said carriage, said carriage slidably disposed on said Y-axis shaft;

a sub-shaft parallel to said Y-axis shaft and penetrating said carriage on the leading end side of said carriage;

two connecting frames forming a frame assembly by connecting and fixing said Y-axis shaft and said sub-shaft to each other at each end of said Y-axis shaft and said sub-shaft;

an origin detecting sensor for detecting the sensor lever of said carriage when said carriage is moved in the direction of the origin, said origin detecting sensor disposed on one of said connecting frames; and an elevating device for moving up and down said sub-shaft to move the frame assembly up and down about said Y-axis shaft and to move the cutter up and down in the Z-axis direction with respect to the cutting sheet, wherein said origin detecting sensor and said carriage are movable in the Z-axis direction in synchronization with each other.

* * * * *